US011831078B1

(12) United States Patent
Lin

(10) Patent No.: US 11,831,078 B1
(45) Date of Patent: Nov. 28, 2023

(54) ACTIVE ARRAY ANTENNA MODULE

(71) Applicant: WANSHIH ELECTRONIC CO., LTD., New Taipei (TW)

(72) Inventor: Hung-Hsuan Lin, New Taipei (TW)

(73) Assignee: WANSHIH ELECTRONIC CO., LTD., New Taipei (TW)

( * ) Notice: Subject to any disclaimer, the term of this patent is extended or adjusted under 35 U.S.C. 154(b) by 0 days.

(21) Appl. No.: 17/742,791

(22) Filed: May 12, 2022

(51) Int. Cl.
*H01Q 21/00* (2006.01)
*H01Q 1/24* (2006.01)
*H01Q 1/02* (2006.01)

(52) U.S. Cl.
CPC ..... *H01Q 21/0025* (2013.01); *H01Q 1/02* (2013.01); *H01Q 1/241* (2013.01)

(58) Field of Classification Search
CPC ..... H01Q 21/00; H01Q 21/0018; H01Q 21/0025; H01Q 21/064; H01Q 21/065; H01Q 1/02; H01Q 1/241; H01Q 9/0407; H01Q 9/0414; H01Q 21/0006; H01Q 23/00
See application file for complete search history.

(56) References Cited

U.S. PATENT DOCUMENTS

2008/0204350 A1* 8/2008 Tam ..... H01Q 21/0025 343/872
2016/0301143 A1* 10/2016 Cao ..... H01Q 13/18
2018/0219277 A1* 8/2018 Hirata ..... H01Q 1/02
2021/0119345 A1* 4/2021 Tan ..... H01Q 21/064
2021/0159608 A1* 5/2021 Verd ..... H01Q 9/285

* cited by examiner

*Primary Examiner* — Thai Pham
(74) *Attorney, Agent, or Firm* — Chun-Ming Shih; HDLS IPR SERVICES

(57) ABSTRACT

An active array antenna module includes a cover plate, a metal frame, an antenna main board, a back frame, and a plurality of first fixing structures. The first fixing structures fix the back frame, the metal frame, and the cover plate, so that the antenna main board is fixed between the metal frame and the back frame, so that each of a plurality of antenna units of the antenna main board corresponds to each of a plurality of openings defined by the metal frame and each of a plurality of metal patterns of the cover plate to form a cavity antenna unit, and the active array antenna module includes a plurality of the cavity antenna units.

13 Claims, 10 Drawing Sheets

ACTIVE ARRAY ANTENNA MODULE

BACKGROUND OF THE DISCLOSURE

Technical Field

The present disclosure relates to an antenna module, and especially relates to an active array antenna module.

Description of Related Art

The fifth-generation mobile communication starts generally introducing the millimeter-wave frequency band, and the demand for high-gain array antennas in the millimeter-wave frequency band also starts increasing significantly. Due to the characteristics of the millimeter-wave channels, the base stations generally require phased arrays with more than 16 elements to provide high enough gain to meet the link requirement. Currently, the integrated solutions provided by most of the manufacturers are based on the multi-layer printed circuit boards, which carry the functional components such as the radio frequency chips, the block antennas, the radio frequency feed lines, the digital control lines and so on, so as to produce the highly integrated millimeter-wave phased array antenna module.

However, this multi-layer circuit board-based integration has many difficulties and conflicts. First, the radio frequency feed lines must be responsible for connecting and collecting the signals of each sub-array, but as the number of the array elements increases, the radio frequency feed lines become longer and more complex, so that the loss of the radio frequency signal is greater. Especially when the radio frequency system has the dual-polarization specification requirement, wiring the feed lines is more difficult, and more layers of the printed circuit board are required to deal with the interleaving problems. In order to have the sufficient bandwidth, the antenna structure often requires a large antenna-ground plane spacing, which requires the thicker printed circuit board layers or is achieved with the multiple stacks. These limitations also increase the difficulty of the stack-up design of the printed circuit board.

FIG. 1 shows a partial cross-sectional schematic diagram of a related art active array antenna module. As shown in FIG. 1, this is a commonly used high density interconnect (usually abbreviated as HDI) multi-layer structure of the printed circuit board, which is based on a core board 158 and uses a build-up method to coat the film layer (PP, prepreg, also known as the thin insulating material) and the copper foil layer by layer upward and downward, and each layer is connected by the laser drilling. The multi-layer is centered on the core board 158, with the same number of the layers above and below to maintain the structural symmetry. The lower part of the core board 158 is the antenna structure, and the upper part is various signal wiring, power supply, ground plane and so on. FIG. 1 also shows a beam forming integrated circuit 156.

Due to the need to consider the characteristics such as the bandwidth and the field type, the antenna structure occupies a large number of the layers, and requires a clear area, which is exclusive, and the ground plane should also avoid any opening or cutting, so the arrangement that the lower-half part is the antenna structure while the upper-half part is the arrangement of the signals and other lines is used. The result of such arrangement is a high-density interconnected stack structure of up to 12 layers, but the actual utilization efficiency is low, and only six layers can be used for dense routing, and the antenna structure does not actually need so many layers. In addition, after the signals of each sub-array are collected, the calibration of each antenna unit also increases the difficulty. The stacking structure of the dozens of the layers and the multi-layer blind holes and the buried holes, plus the huge number of the arrays and the wirings, will increase the difficulty of the calibration, and the defects are difficult to be eliminated. Various unfavorable factors make the current active array antenna modules remain at the high cost and extremely complex.

SUMMARY OF THE DISCLOSURE

In order to solve the above-mentioned problems, an object of the present disclosure is to provide an active array antenna module.

In order to solve the above-mentioned problems, another object of the present disclosure is to provide an active array antenna module.

In order to achieve the object of the present disclosure mentioned above, the active array antenna module of the present disclosure includes a cover plate, a metal frame, an antenna main board, at least one first integrated circuit, a back frame, and a plurality of first fixing structures. The cover plate is a dielectric substrate and includes a plurality of metal patterns. The metal frame is arranged on the cover plate. The metal frame defines a plurality of openings. The antenna main board is arranged on the metal frame. The antenna main board is a multi-layer circuit board and includes a plurality of antenna units and a plurality of radio frequency feed lines. The radio frequency feed lines are electrically connected to the antenna units. The at least one first integrated circuit is arranged on the antenna main board. The radio frequency feed lines are electrically connected between the antenna units and the at least one first integrated circuit. The back frame is arranged on the antenna main board. The back frame is made of a metal. The first fixing structures fix the back frame, the metal frame, and the cover plate, so that the antenna main board is fixed between the metal frame and the back frame, so that each of the antenna units of the antenna main board corresponds to each of the openings defined by the metal frame and each of the metal patterns of the cover plate to form a cavity antenna unit, and the active array antenna module includes a plurality of the cavity antenna units.

Moreover, in an embodiment of the active array antenna module of the present disclosure mentioned above, the antenna units are dual-polarized antennas.

Moreover, in an embodiment of the active array antenna module of the present disclosure mentioned above, the active array antenna module further includes at least one high frequency connector arranged on the antenna main board, wherein the at least one high frequency connector is a surface mount technology component.

Moreover, in an embodiment of the active array antenna module of the present disclosure mentioned above, the active array antenna module further includes a heat dissipation structure assembled to the back frame, the metal frame, and the cover plate.

Moreover, in an embodiment of the active array antenna module of the present disclosure mentioned above, the at least one first integrated circuit is a beam forming integrated circuit.

Moreover, in an embodiment of the active array antenna module of the present disclosure mentioned above, a first number of the openings defined by the metal frame is equal to a second number of the antenna units of the antenna main board.

In order to achieve the another object of the present disclosure mentioned above, the active array antenna module of the present disclosure includes a cover plate, a metal frame, a plurality of antenna main boards, at least one first integrated circuit, a back frame, and a plurality of first fixing structures. The cover plate is a dielectric substrate and includes a plurality of metal patterns. The metal frame is arranged on the cover plate. The metal frame defines a plurality of openings. The antenna main boards are arranged on the metal frame. Each of the antenna main boards is a multi-layer circuit board and includes a plurality of antenna units and a plurality of radio frequency feed lines. The radio frequency feed lines are electrically connected to the antenna units. The at least one first integrated circuit is arranged on the antenna main boards. The radio frequency feed lines are electrically connected between the antenna units and the at least one first integrated circuit. The back frame is arranged on the antenna main boards. The back frame is made of a metal. The first fixing structures fix the back frame, the metal frame, and the cover plate, so that the antenna main boards are fixed between the metal frame and the back frame, so that each of the antenna units of the antenna main boards corresponds to each of the openings defined by the metal frame and each of the metal patterns of the cover plate to form a cavity antenna unit, and the active array antenna module includes a plurality of the cavity antenna units.

Moreover, in an embodiment of the active array antenna module of the present disclosure mentioned above, the antenna units are dual-polarized antennas.

Moreover, in an embodiment of the active array antenna module of the present disclosure mentioned above, the active array antenna module further includes a heat dissipation structure assembled to the back frame, the metal frame, and the cover plate.

Moreover, in an embodiment of the active array antenna module of the present disclosure mentioned above, the at least one first integrated circuit is a beam forming integrated circuit.

Moreover, in an embodiment of the active array antenna module of the present disclosure mentioned above, the active array antenna module further includes at least one high frequency connector arranged on the antenna main boards, wherein the at least one high frequency connector is a surface mount technology component.

Moreover, in an embodiment of the active array antenna module of the present disclosure mentioned above, the active array antenna module further includes at least one transmission line and an N-way power integrator. The at least one transmission line is electrically connected to the at least one high frequency connector. The N-way power integrator is electrically connected to the at least one transmission line. Moreover, the at least one high frequency connector is connected to the N-way power integrator through the at least one transmission line. The N-way power integrator is a power splitter or a power combiner.

Moreover, in an embodiment of the active array antenna module of the present disclosure mentioned above, a first number of the openings defined by the metal frame is equal to a second number of the antenna units of the antenna main boards.

The advantage of the present disclosure is to provide an active array antenna module with a simple structure.

Please refer to the detailed descriptions and figures of the present disclosure mentioned below for further understanding the technology, method and effect of the present disclosure achieving the predetermined purposes. It believes that the purposes, characteristic and features of the present disclosure can be understood deeply and specifically. However, the figures are only for references and descriptions, but the present disclosure is not limited by the figures.

DETAILED DESCRIPTION

Figure 2:
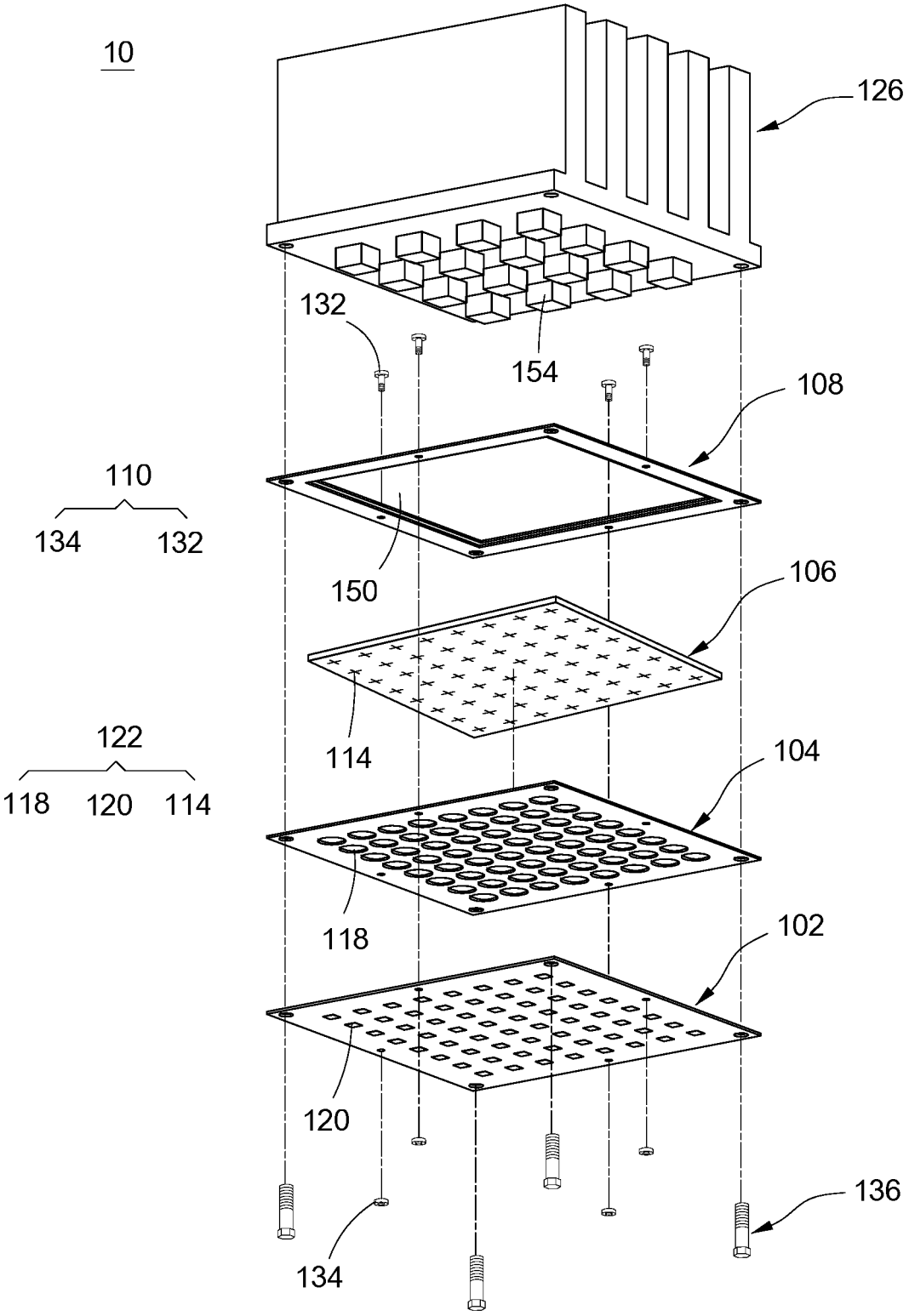
FIG. 2 shows a bottom exploded view of the embodiment of the active array antenna module of the present disclosure.
Figure 3:
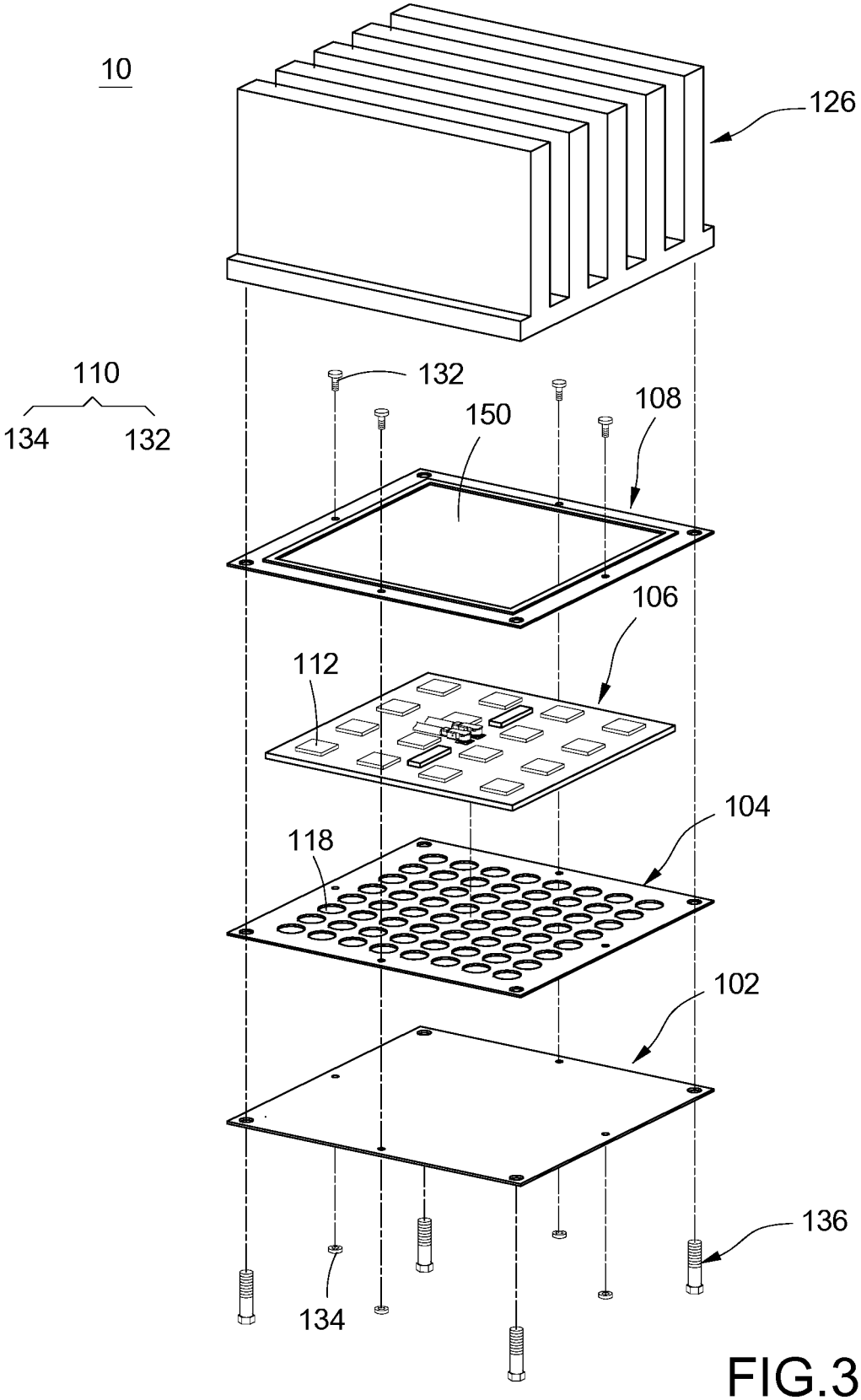
FIG. 3 shows a top exploded view of the embodiment of the active array antenna module of the present disclosure.
Figure 4:
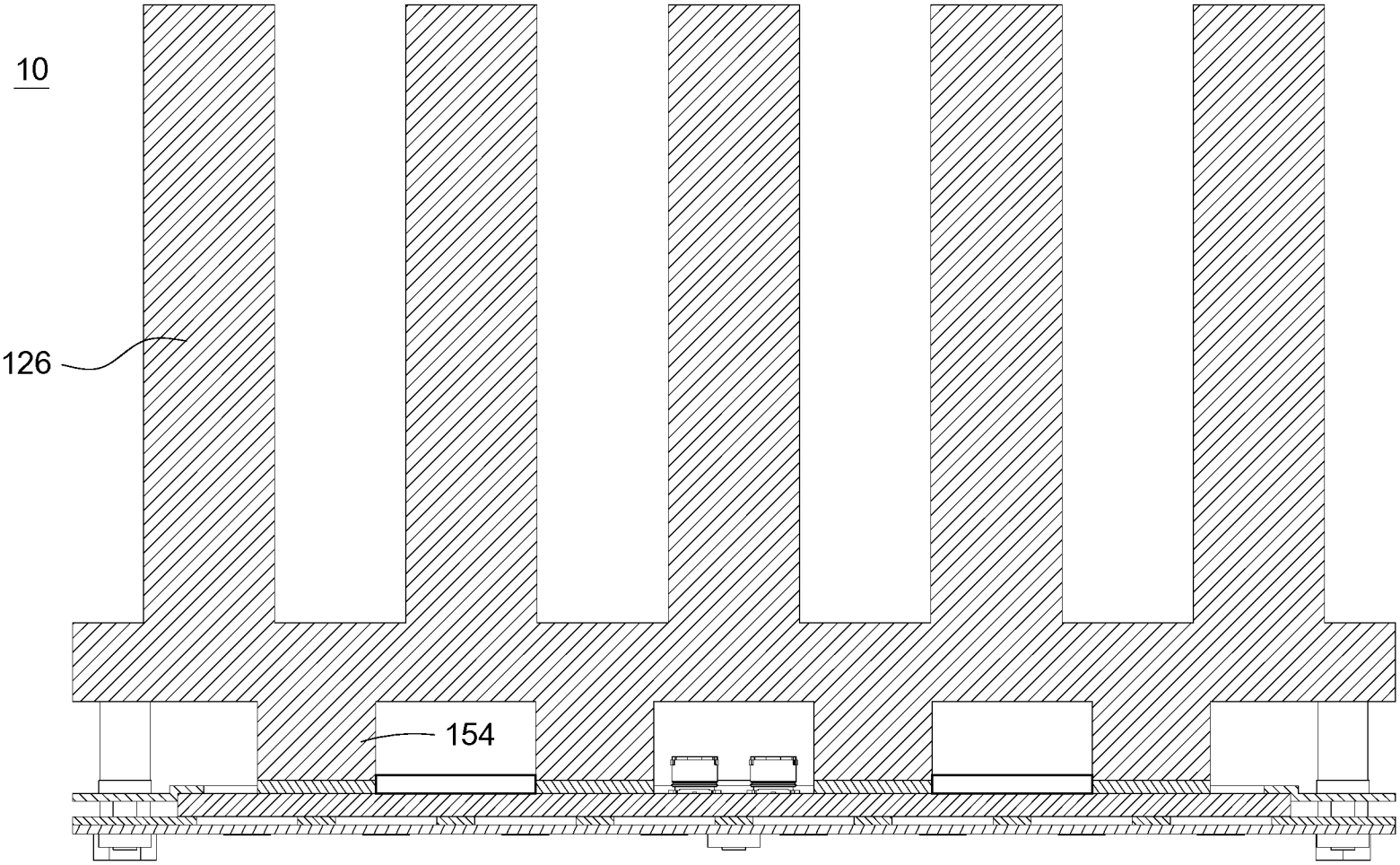
FIG. 4 shows a cross-sectional assembly drawing of the embodiment of the active array antenna module of the present disclosure.
Figure 5:
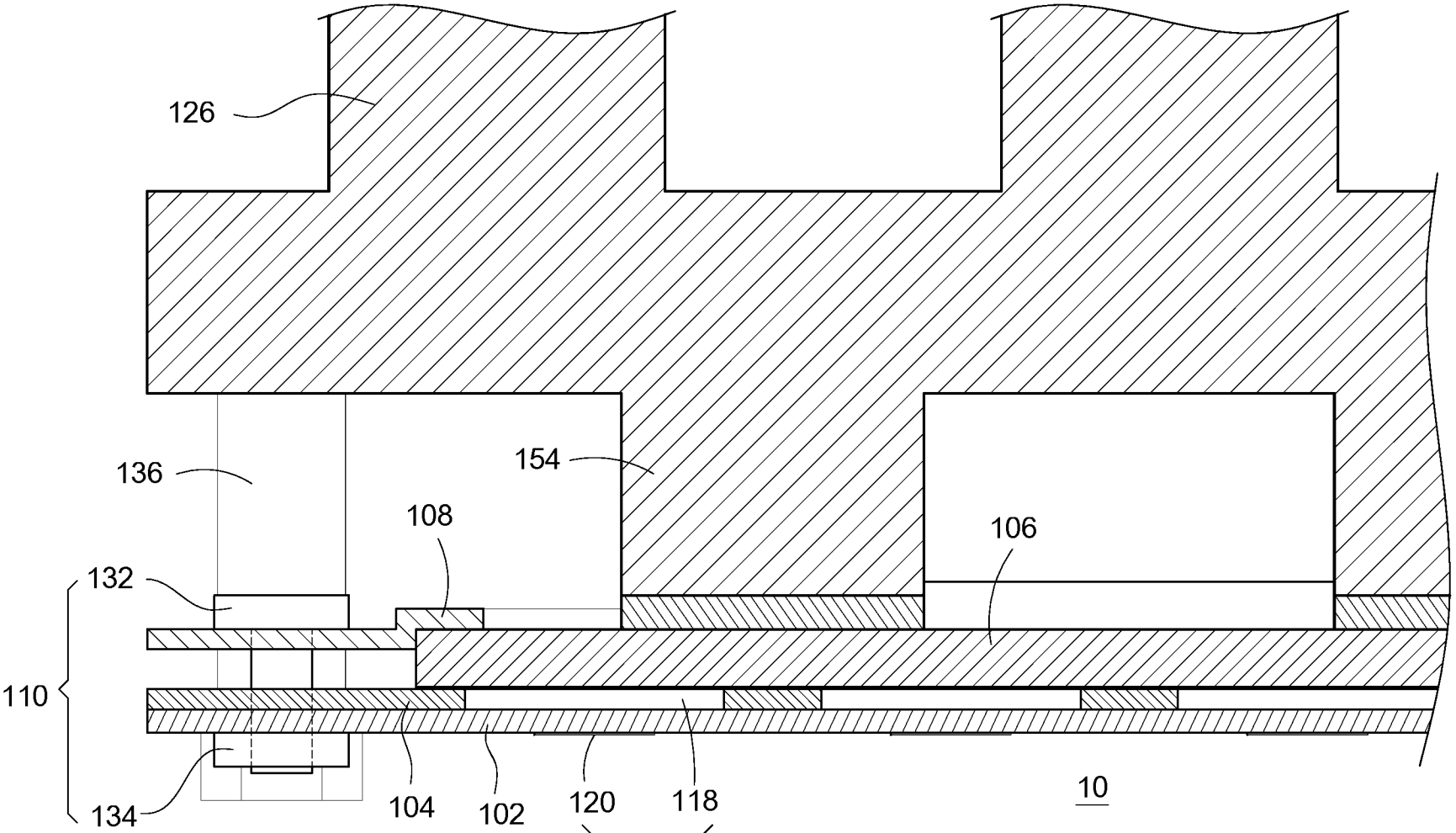
FIG. 5 is a partial enlarged view of FIG. 4.
Figure 6:
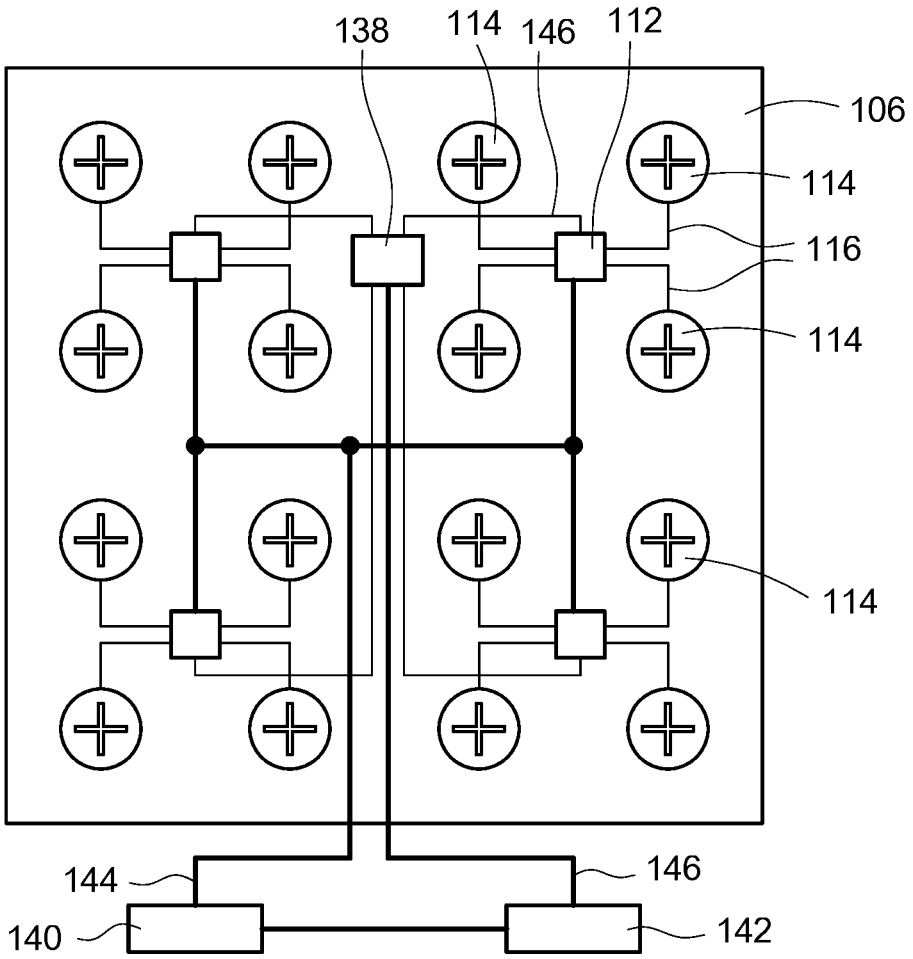
FIG. 6 shows a circuit block diagram of a part of the embodiment of the active array antenna module of the present disclosure.
Figure 7:
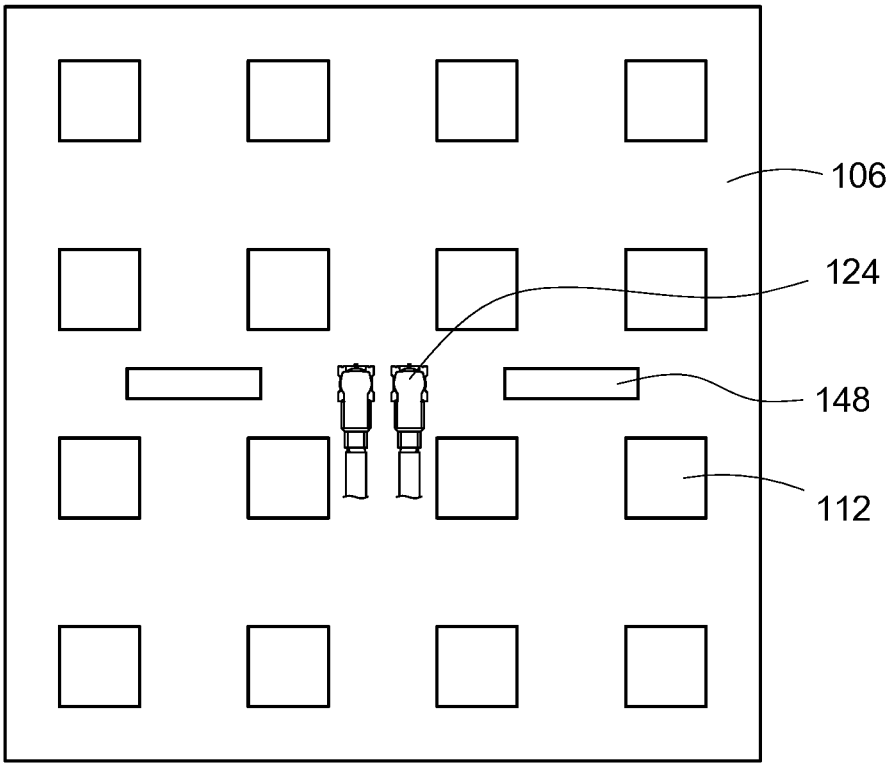
FIG. 7 shows a circuit block diagram (for example, a back view) of a part of the embodiment of the active array antenna module of the present disclosure.

In the present disclosure, numerous specific details are provided, to provide a thorough understanding of embodiments of the disclosure. Persons of ordinary skill in the art will recognize, however, that the present disclosure can be practiced without one or more of the specific details. In other instances, well-known details are not shown or described to avoid obscuring aspects of the present disclosure. Now please refer to the figures for the explanation of the technical content and the detailed description of the present disclosure:

FIG. 2 shows a bottom exploded view of the embodiment of the active array antenna module of the present disclosure. FIG. 3 shows a top exploded view of the embodiment of the active array antenna module of the present disclosure. FIG. 4 shows a cross-sectional assembly drawing of the embodiment of the active array antenna module of the present disclosure. FIG. 5 is a partial enlarged view of FIG. 4. FIG. 6 shows a circuit block diagram of a part of the embodiment of the active array antenna module of the present disclosure. FIG. 7 shows a circuit block diagram (for example, a back view) of a part of the embodiment of the active array antenna module of the present disclosure. Please refer to FIG. 2, FIG. 3, FIG. 4, FIG. 5, FIG. 6, and FIG. 7 at the same time. As shown in FIG. 2, an active array antenna module 10 of the present disclosure includes a cover plate 102, a metal frame 104, an antenna main board 106, a back frame 108, a plurality of first fixing structures 110, at least one first integrated circuit 112 (as shown in FIG. 6), at least one high frequency connector 124 (as shown in FIG. 7) and a heat dissipation structure 126. The active array antenna module 10 of the present disclosure can also be referred to as a millimeter-wave active antenna module.

As shown in FIG. 2, the cover plate 102 is a dielectric substrate and includes a plurality of metal patterns 120. The metal frame 104 is arranged on the cover plate 102. The metal frame 104 defines a plurality of openings 118. The antenna main board 106 is arranged on the metal frame 104. The antenna main board 106 is a multi-layer circuit board and includes a plurality of antenna units 114 (as shown in FIG. 2) and a plurality of radio frequency feed lines 116 (as shown in FIG. 6). The radio frequency feed lines 116 are electrically connected to the antenna units 114. The back frame 108 is arranged on the antenna main board 106. The back frame 108 is made of a metal. The at least one first integrated circuit 112 (as shown in FIG. 6) is arranged on the antenna main board 106. The radio frequency feed lines 116 are electrically connected between the antenna units 114 and the at least one first integrated circuit 112. The at least one high frequency connector 124 (as shown in FIG. 7) is arranged on the antenna main board 106. The at least one high frequency connector 124 is a surface mount technology component, thereby reducing the clear area and the mechanical space required on the antenna main board 106. The heat dissipation structure 126 is assembled to the back frame 108, the metal frame 104 and the cover plate 102.

As shown in FIG. 5, the first fixing structures 110 fix the back frame 108, the metal frame 104 and the cover plate 102, so that the antenna main board 106 is fixed between the metal frame 104 and the back frame 108, so that each of the antenna units 114 (as shown in FIG. 2) of the antenna main board 106 corresponds to each of the openings 118 (as shown in FIG. 2) defined by the metal frame 104 and each of the metal patterns 120 (as shown in FIG. 2) of the cover plate 102 to form a cavity antenna unit 122 (as shown in FIG. 2) (namely, the cavity antenna unit 122 includes the one antenna unit 114, the one opening 118 and the one metal pattern 120; the antenna unit 114, the opening 118 and the metal pattern 120 are in one-to-one correspondence, but the present disclosure is not limited by it), and the active array antenna module 10 includes a plurality of the cavity antenna units 122.

The at least one first integrated circuit 112 is, for example but not limited to, a beam forming integrated circuit. For example, the at least one first integrated circuit 112 is a radio frequency front-end integrated circuit with the beam forming function, which at least includes a phase shifter (not shown in these figures), and some even integrate the transceivers. Most of the radio frequency front-end integrated circuits can correspond to the plurality of the antenna units 114 in one package, for example, one integrated circuit corresponds to four of the antenna units 114. In addition, some integrated circuits having the functions such as the power management or the digital control may also be arranged on the antenna main board 106. The antenna units 114 are, for example but not limited to, the dual-polarized antennas, the patch antennas, or the slot antennas. A first number of the openings 118 defined by the metal frame 104 is, for example but not limited to, equal to a second number (for example, both are 64) of the antenna units 114 of the antenna main board 106.

Moreover, the metal patterns 120 of the cover plate 102 are arranged on one side of the cover plate 102 or inside the cover plate 102, and shapes of the metal patterns 120 are the same or similar, such as the square, the octagon, or the circular. Basically, each of the metal patterns 120 corresponds to one of the openings 118 and one of the antenna elements 114. The back frame 108 includes a groove or a similar structure for positioning the antenna main board 106. The main function of the back frame 108 is to provide the cover plate 102, the metal frame 104 and the antenna main board 106 to be assembled. The metal frame 104 and the openings 118 form a fixed cavity between the antenna main board 106 and the cover plate 102, so that the characteristics such as the bandwidth and the efficiency of the antenna can be improved.

Moreover, each of the first fixing structures 110 includes a first screw 132 and a first nut 134, and the first screw 132 is screwed to the first nut 134 through the back frame 108, the metal frame 104 and the cover plate 102, so that the first screw 132 and the first nut 134 screw and fix the back frame 108, the metal frame 104 and the cover plate 102, and the antenna main board 106 is arranged/sandwiched between the back frame 108 and the metal frames 104, as shown in FIG. 5. The active array antenna module 10 further includes a plurality of second screws 136 which screw and fix the heat dissipation structure 126, the back frame 108, the metal frame 104 and the cover plate 102.

Moreover, the cover plate 102, the metal frame 104, the antenna main board 106 and the back frame 108 which have been relatively fixed may be assembled with the heat dissipation structure 126. The heat dissipation structure 126 includes a plurality of bumps 154 to correspond to the integrated circuits and to avoid the connectors and other components on the antenna main board 106. The bumps 154 may be coated with the thermal grease, or other objects with the similar functions may be placed on the bumps 154, to enhance the thermal conductivity.

Moreover, as shown in FIG. 7, the active array antenna module 10 further includes at least one electronic connector 148 arranged on the antenna main board 106. The at least one electronic connector 148 is a surface mount technology component, thereby reducing the clear area and the mechanical space required on the antenna main board 106. The at least one electronic connector 148 is used as an interface for the communication and the power transmission between the electronic components on the antenna main board 106 and the main system, so as to provide the integrated circuits and each component on the antenna main board 106 with the required signal reception/transmission, power, ground and so on. The at least one high frequency connector 124 is used to transmit the high frequency signals, such as the radio frequency signals or the intermediate frequency signals (if the integrated circuit includes an integrated transceiver). A plurality of the high frequency connectors 124 may be used to correspond to the antenna ports of different polarities or different groups, or correspond to the links of different transmitting/receiving, or correspond to different signals of the intermediate frequency I/Q. The at least one high frequency connector 124 may be arranged on the antenna main board 106 near the center, thereby reducing the length of the transmission line in the multi-layer circuit board.

Moreover, as shown in FIG. 6, the active array antenna module 10 further includes a decoder integrated circuit 138, a transceiver 140 and a baseband processor 142. The antenna main board 106 further includes a high frequency distribution network 144 and a plurality of digital control lines 146. The decoder integrated circuit 138 is electrically connected to the at least one first integrated circuit 112. The transceiver 140 is electrically connected to the at least one first integrated circuit 112. The baseband processor 142 is electrically connected to the decoder integrated circuit 138 and the transceiver 140. The high frequency distribution network 144 is electrically connected between the at least one first integrated circuit 112 and the transceiver 140. The digital control lines 146 are electrically connected between the decoder integrated circuit 138 and the at least one first integrated circuit 112. The digital control lines 146 are electrically connected between the decoder integrated circuit 138 and the baseband processor 142. The antenna main board 106 further includes a plurality of power lines (not shown in the figures) and a plurality of ground lines (not shown in the figures) and so on required by the integrated circuits.

Figure 8:
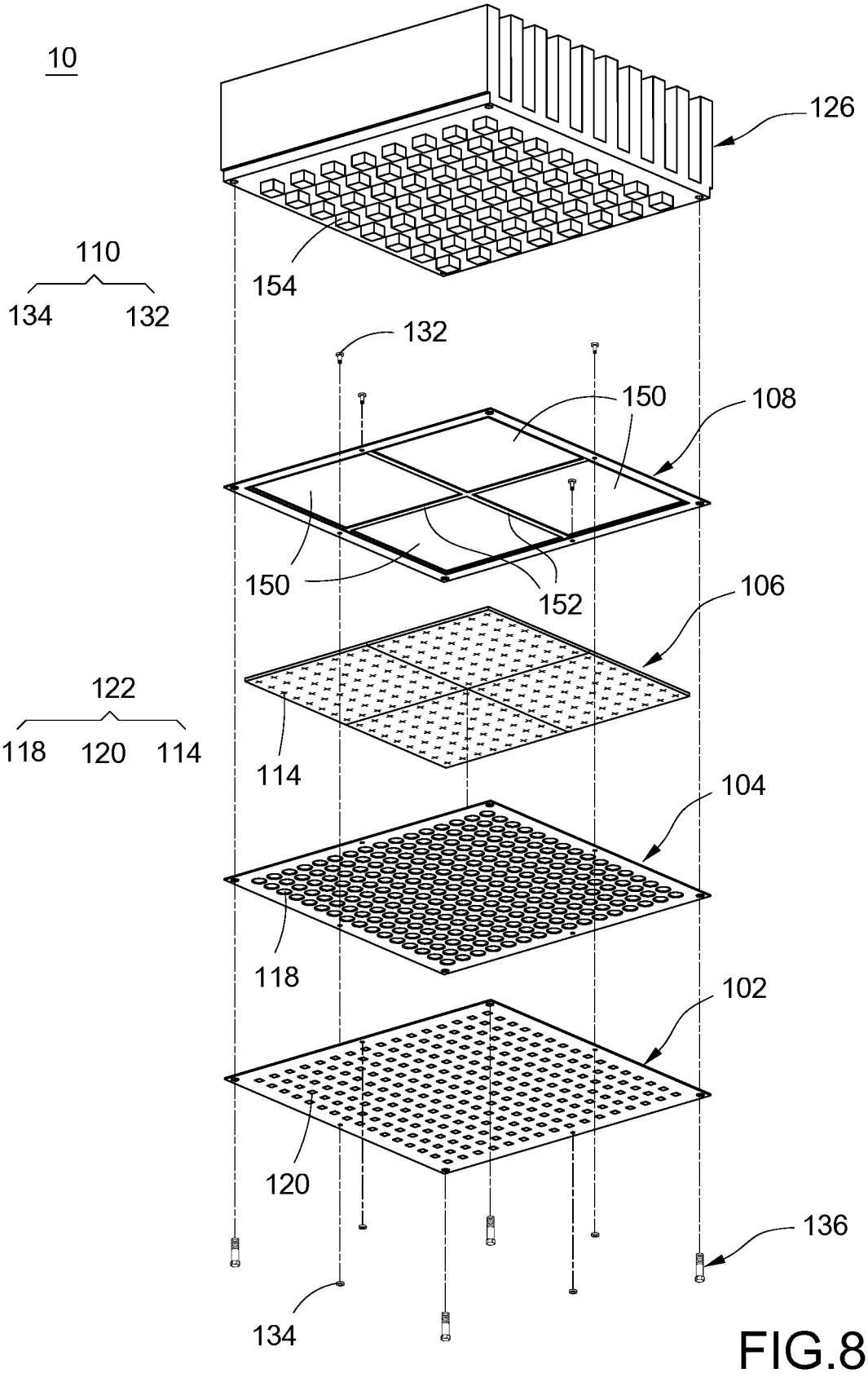
FIG. 8 shows a bottom exploded view of another embodiment of the active array antenna module of the present disclosure.
Figure 9:
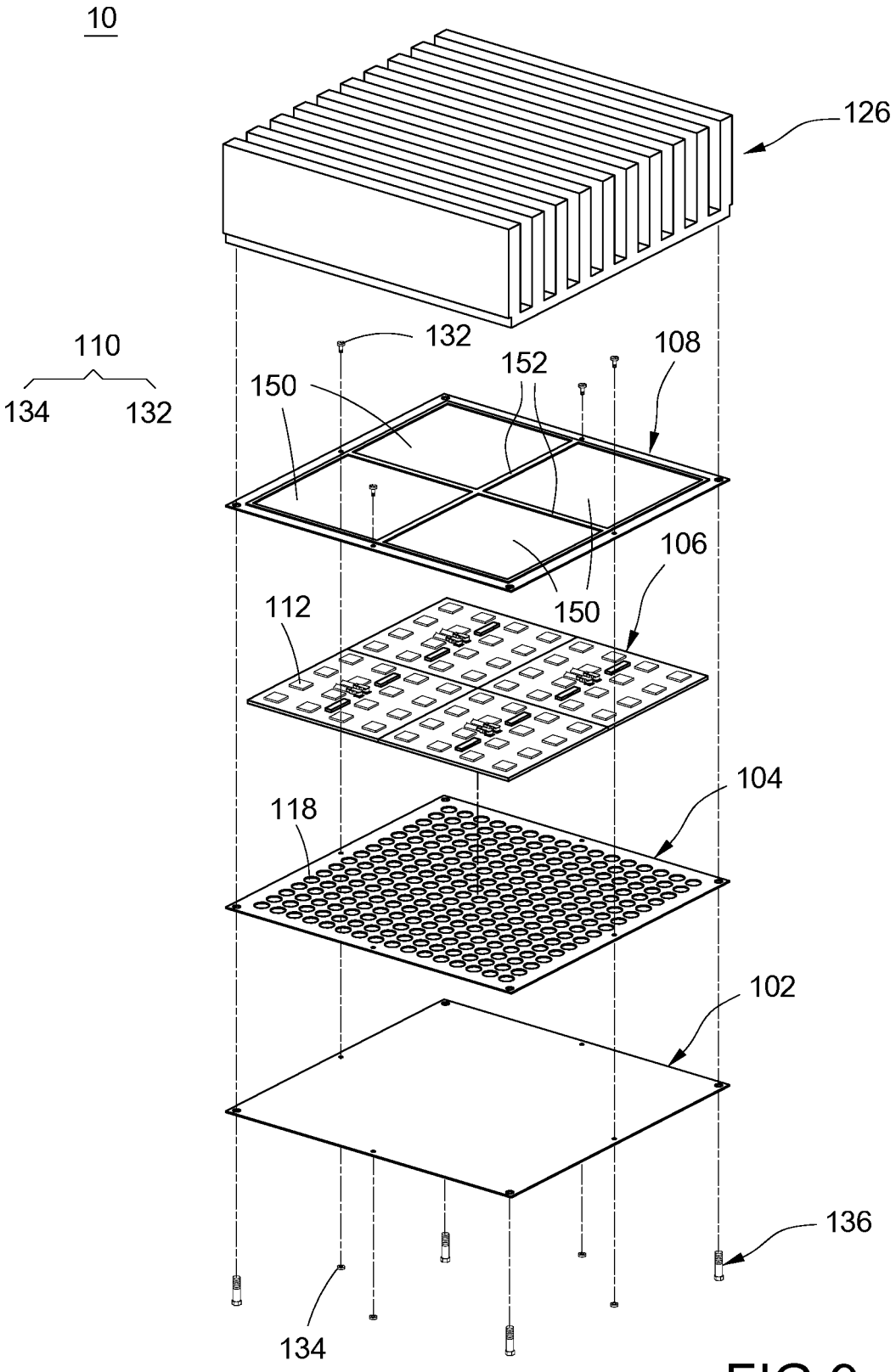
FIG. 9 shows a top exploded view of another embodiment of the active array antenna module of the present disclosure.

FIG. 8 shows a bottom exploded view of another embodiment of the active array antenna module of the present disclosure. FIG. 9 shows a top exploded view of another embodiment of the active array antenna module of the present disclosure. The embodiment of FIG. 8 and FIG. 9 is similar to the embodiment of FIG. 2 and FIG. 3, so the embodiment of FIG. 8 and FIG. 9 will not be repeated here for brevity; the difference is that the active array antenna module 10 of the embodiment of FIG. 8 and FIG. 9 includes a plurality of the antenna main boards 106 (for example, four of the antenna main boards 106).

The antenna main boards 106 are arranged on the metal frame 104. Each of the antenna main boards 106 is a multi-layer circuit board and includes a plurality of the antenna units 114 (as shown in FIG. 8) and a plurality of the radio frequency feed lines (as shown in FIG. 6). The at least one first integrated circuit 112 (as shown in FIG. 7) is arranged on the antenna main boards 106. The back frame 108 is arranged on the antenna main boards 106.

The first fixing structures 110 fix the back frame 108, the metal frame 104 and the cover plate 102, so that the antenna main boards 106 are fixed between the metal frame 104 and the back frame 108, so that each of the antenna units 114 (as shown in FIG. 6) of the antenna main boards 106 corresponds to each of the openings 118 defined by the metal frame 104 and each of the metal patterns 120 of the cover plate 102 to form the cavity antenna unit 122, and the active array antenna module 10 includes the plurality of the cavity antenna units 122. The at least one high frequency connector 124 (as shown in FIG. 7) is arranged on the antenna main boards 106. The first number of the openings 118 defined by the metal frame 104 is, for example but not limited to, equal to the second number (for example, both are 256) of the antenna units 114 of the antenna main boards 106.

Figure 10:
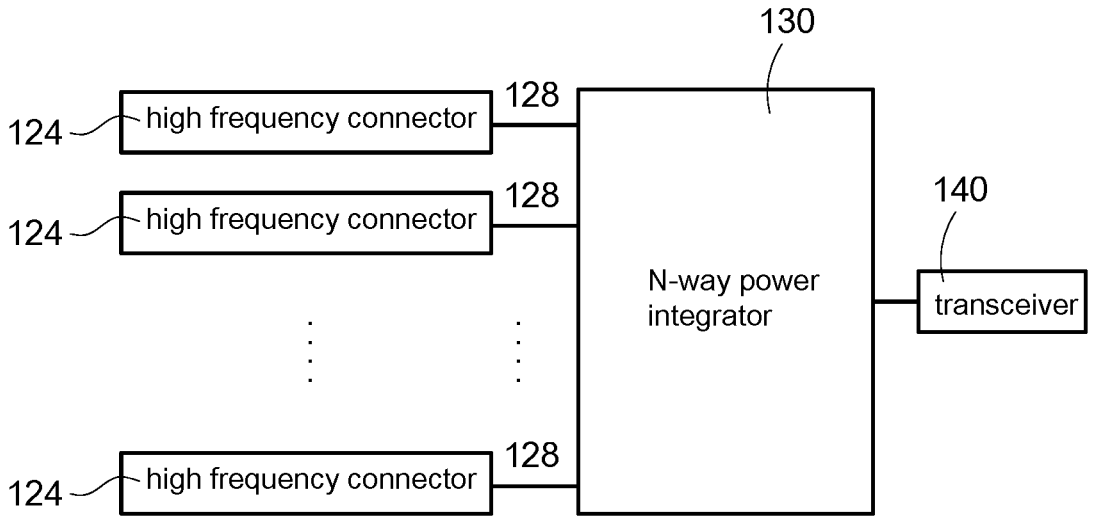
FIG. 10 shows a circuit block diagram of a part of the embodiment of the active array antenna module of the present disclosure.

FIG. 10 shows a circuit block diagram of a part of the embodiment of the active array antenna module of the present disclosure. The active array antenna module 10 further includes at least one transmission line 128 and an N-way power integrator 130. The at least one transmission line 128 is electrically connected to the at least one high frequency connector 124. The N-way power integrator 130 is electrically connected to the at least one transmission line 128. The at least one high frequency connector 124 is connected to the N-way power integrator 130 through the at least one transmission line 128. The N-way power integrator 130 is, for example but not limited to, a power splitter or a power combiner. FIG. 10 shows N pieces of the at least one high frequency connectors 124 and N pieces of the at least one transmission lines 128. Moreover, the N-way power integrator 130 is electrically connected to the transceiver 140.

Moreover, compared to the back frame 108 having only a single section 150 (as shown in the embodiment of FIG. 2 and FIG. 3), the back frame 108 having a plurality of the sections 150 (as shown in the embodiment of FIG. 8 and FIG. 9) can provide the higher mechanical strength, and the antenna units 114 are separated from each other by the metal walls to avoid the propagation of the transverse modes. Namely, the back frame 108 includes a plurality of metal walls 152 to separate the back frame 108 into a plurality of sections 150, and each of the sections 150 corresponds to each of the antenna main boards 106.

The embodiment of FIG. 8 and FIG. 9 has the following characteristics:

1. The antenna main board 106 with a smaller area is used; due to the small area, the yield rate is relatively easy to improve.

2. A single core component and the antenna main board 106 may have the advantages in the production and the inventory management.

3. The Use is More Flexible; in the Same Rectangular Arrangement, the Radio Frequency Signals of the 4 modules may be connected with an external power splitter/power combiner to become a high-gain antenna module; or the 4 modules may be connected to four modules respectively with the dual-polarization design, and may achieve 8 independently controlled beams, which greatly increase the capacity of the communication system. Or combine horizontally or vertically according to different arrangement requirements to achieve the best efficiency.

Benefiting from the assembling method of the present disclosure, the interval between the antenna module and the antenna module may be reduced to a very small extent, so as to reduce the negative influence when the sub-array composes the high-gain antenna.

Figure 1:
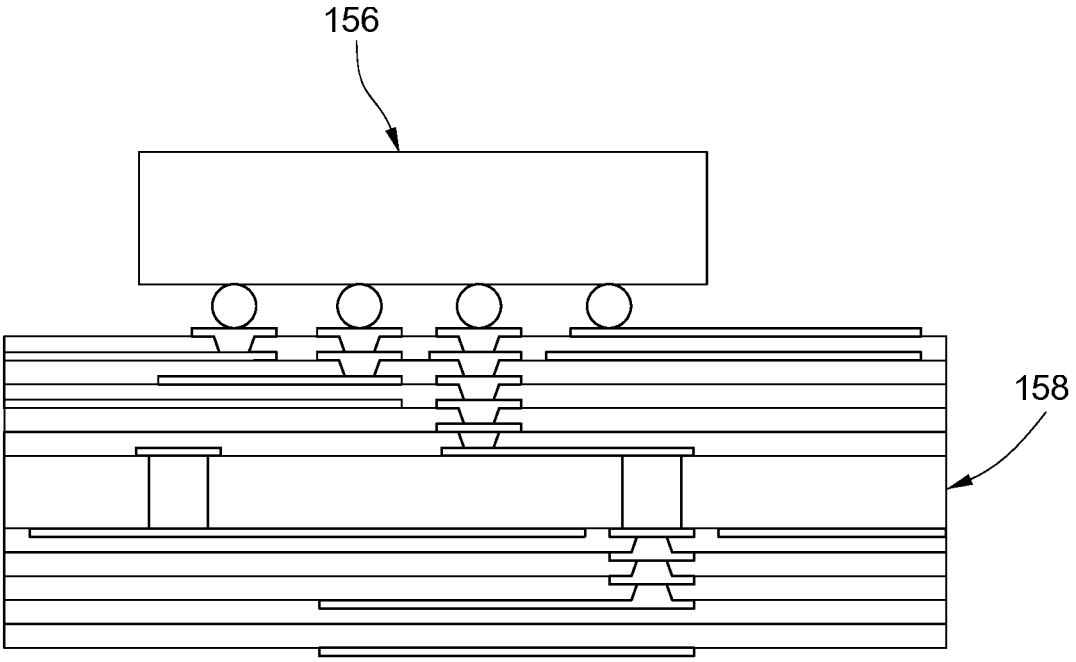
FIG.1 (Related Art)
FIG. 1 shows a partial cross-sectional schematic diagram of a related art active array antenna module.
Figure 11:
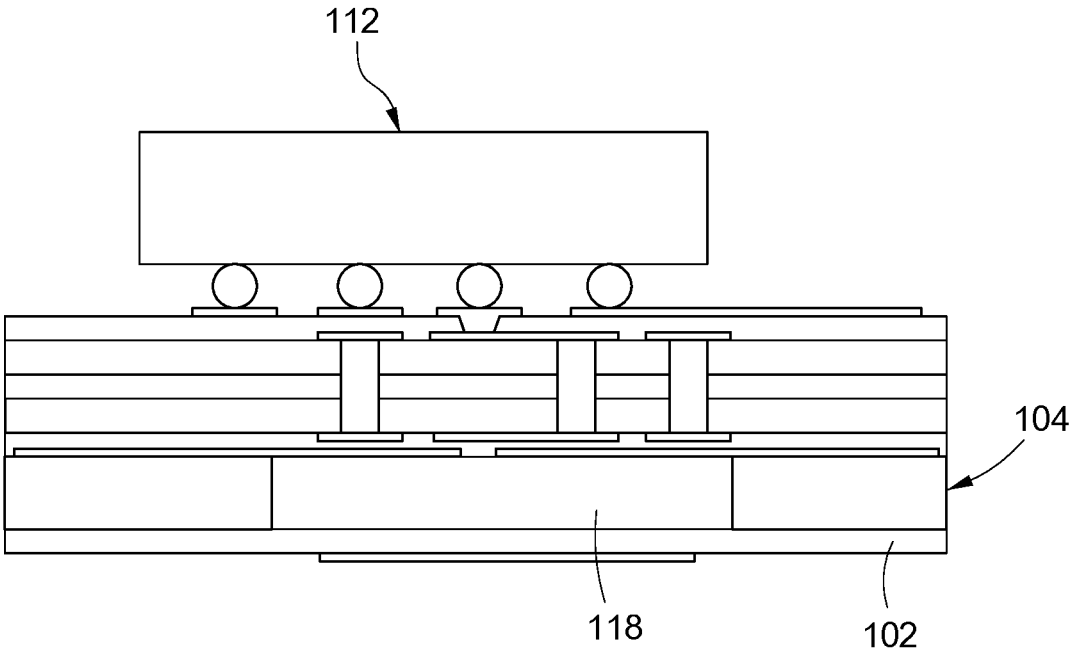
FIG. 11 shows a partial cross-sectional schematic diagram of the embodiment of the active array antenna module of the present disclosure.

FIG. 11 shows a partial cross-sectional schematic diagram of the embodiment of the active array antenna module of the present disclosure. Compared with the related art active array antenna module shown in FIG. 1 having up to 12 layers of the printed circuit boards, the active array antenna module of the present disclosure requires less than 8 layers of the printed circuit boards.

The present disclosure is a millimeter-wave array antenna module composed of a heterogeneous structure, and the main features of the present disclosure are as following:

1. The air layer antenna structure may make the antenna have the characteristics of the high efficiency and the wide frequency band.

2. The number of the layers in the multi-layer printed circuit board may be reduced.

3. The external assembly structure may reduce the board edge space required for the multi-layer printed circuit board assembly, thereby improving the area utilization rate.

4. The modular design of the antenna main board may combine a plurality of the antenna main boards to form a large-scale high-gain array or a multi-beam high-capacity structure according to different requirements.

5. Easy to assemble with the large cooling structures or the chassis.

The advantage of the present disclosure is to provide an active array antenna module with a simple structure.

Although the present disclosure has been described with reference to the embodiment thereof, it will be understood that the disclosure is not limited to the details thereof. Various substitutions and modifications have been suggested in the foregoing description, and others will occur to those of ordinary skill in the art. Therefore, all such substitutions and modifications are intended to be embraced within the scope of the disclosure as defined in the appended claims.

What is claimed is:

1. An active array antenna module comprising:

a cover plate being a dielectric substrate and comprising a plurality of metal patterns;

a metal frame arranged on the cover plate and defining a plurality of openings;

an antenna main board arranged on the metal frame, and being a multi-layer circuit board, and comprising a plurality of antenna units and a plurality of radio frequency feed lines electrically connected to the antenna units;

at least one first integrated circuit arranged on the antenna main board, the radio frequency feed lines being electrically connected between the antenna units and the at least one first integrated circuit;

a back frame arranged on the antenna main board and made of a metal; and a plurality of first fixing structures fixing the back frame, the metal frame, and the cover plate, so that the antenna main board is fixed between the metal frame and the back frame, so that each of the antenna units of the antenna main board corresponds to each of the openings defined by the metal frame and each of the metal patterns of the cover plate to form a cavity antenna unit, wherein the active array antenna module comprises a plurality of the cavity antenna units;

wherein each of the first fixing structures includes a first screw and a first nut, and the first screw is screwed to the first nut through the back frame, the metal frame and the cover plate, so that the first screw and the first nut screw and fix the back frame, the metal frame and the cover plate, and the antenna main board is arranged/sandwiched between the back frame and the metal frame.

2. The active array antenna module of claim 1, wherein the antenna units are dual-polarized antennas.

3. The active array antenna module of claim 1, further comprising:

at least one high frequency connector arranged on the antenna main board, wherein the at least one high frequency connector is a surface mount technology component.

4. The active array antenna module of claim 1, further comprising:

a heat dissipation structure; and a plurality of second fixing structures comprising a plurality of second screws which screw and fix the heat dissipation structure, the back frame, the metal frame and the cover plate, so that the cover plate, the metal frame, the antenna main board and the back frame which are relatively fixed are assembled with the heat dissipation structures.

5. The active array antenna module of claim 1, wherein the at least one first integrated circuit is a beam forming integrated circuit.

6. The active array antenna module of claim 1, wherein a first number of the openings defined by the metal frame is equal to a second number of the antenna units of the antenna main board.

7. An active array antenna module comprising:

a cover plate being a dielectric substrate and comprising a plurality of metal patterns;

a metal frame arranged on the cover plate and defining a plurality of openings;

a plurality of antenna main boards arranged on the metal frame, each of the antenna main boards being a multi-layer circuit board and comprising a plurality of antenna units and a plurality of radio frequency feed lines, the radio frequency feed lines being electrically connected to the antenna units;

at least one first integrated circuit arranged on the antenna main boards, the radio frequency feed lines being electrically connected between the antenna units and the at least one first integrated circuit;

a back frame arranged on the antenna main boards and made of a metal; and a plurality of first fixing structures fixing the back frame, the metal frame, and the cover plate, so that the antenna main boards are fixed between the metal frame and the back frame, so that each of the antenna units of the antenna main boards corresponds to each of the openings defined by the metal frame and each of the metal patterns of the cover plate to form a cavity antenna unit, wherein the active array antenna module comprises a plurality of the cavity antenna units;

wherein each of the first fixing structures includes a first screw and a first nut, and the first screw is screwed to the first nut through the back frame, the metal frame and the cover plate, so that the first screw and the first nut screw and fix the back frame, the metal frame and the cover plate, and the antenna main board is arranged/sandwiched between the back frame and the metal frame.

8. The active array antenna module of claim 7, wherein the antenna units are dual-polarized antennas.

9. The active array antenna module of claim 7, further comprising:

a heat dissipation structure; and a plurality of second fixing structures comprising a plurality of second screws which screw and fix the heat dissipation structure, the back frame, the metal frame and the cover plate, so that the cover plate, the metal frame, the antenna main board and the back frame which are relatively fixed are assembled with the heat dissipation structures.

10. The active array antenna module of claim 7, wherein the at least one first integrated circuit is a beam forming integrated circuit.

11. The active array antenna module of claim 7, further comprising:

at least one high frequency connector arranged on the antenna main boards, wherein the at least one high frequency connector is a surface mount technology component.

12. The active array antenna module of claim 11, further comprising:

at least one transmission line electrically connected to the at least one high frequency connector; and an n-way power integrator electrically connected to the at least one transmission line, wherein n is an integer and greater than 1, wherein the at least one high frequency connector is connected to the n-way power integrator through the at least one transmission line; the n-way power integrator is a power splitter or a power combiner.

13. The active array antenna module of claim 7, wherein a first number of the openings defined by the metal frame is equal to a second number of the antenna units of the antenna main boards.

* * * * *